US008163103B2

(12) United States Patent
Shin et al.

(10) Patent No.: US 8,163,103 B2
(45) Date of Patent: Apr. 24, 2012

(54) DISHWASHER AND RACK ASSEMBLY THEREFOR

(75) Inventors: Gap Su Shin, Seoul (KR); Nung Seo Park, Seoul (KR); Yong Jin Choi, Seoul (KR); Young Hwan Park, Seoul (KR); Jae Won Chang, Seoul (KR)

(73) Assignee: LG Electronics Inc., Seoul (KR)

( * ) Notice: Subject to any disclaimer, the term of this patent is extended or adjusted under 35 U.S.C. 154(b) by 1133 days.

(21) Appl. No.: 11/954,674

(22) Filed: Dec. 12, 2007

(65) Prior Publication Data

US 2008/0156362 A1 Jul. 3, 2008

(30) Foreign Application Priority Data

Dec. 29, 2006 (KR) ..... 10-2006-0138626

(51) Int. Cl.
*A47L 15/50* (2006.01)
*A47G 19/08* (2006.01)

(52) U.S. Cl. ..... 134/56 D; 134/57 D; 134/58 D; 134/84; 211/41.8; 211/117; 211/207

(58) Field of Classification Search ..... 134/56 D, 134/57 D, 58 D, 84; 211/41.1, 41.2, 41.3, 211/41.4, 41.8, 113, 117, 207; 312/301
See application file for complete search history.

(56) References Cited

U.S. PATENT DOCUMENTS

| | | | | |
|---|---|---|---|---|
| 5,595,200 | A * | 1/1997 | Favaro | 134/201 |
| 5,657,878 | A * | 8/1997 | Austin | 211/41.8 |
| 5,860,716 | A * | 1/1999 | Good et al. | 312/311 |
| 6,755,490 | B2 * | 6/2004 | Welch et al. | 312/228.1 |
| 2005/0039782 | A1 * | 2/2005 | Kim | 134/58 D |
| 2006/0108298 | A1 * | 5/2006 | Kim | 211/41.8 |
| 2006/0219271 | A1 * | 10/2006 | Feddema et al. | 134/56 D |
| 2006/0237042 | A1 * | 10/2006 | Weaver et al. | 134/25.2 |
| 2006/0250058 | A1 * | 11/2006 | Stevens et al. | 312/311 |

OTHER PUBLICATIONS

Chinese Office Action dated Aug. 27, 2010.

* cited by examiner

*Primary Examiner* — Michael Barr
*Assistant Examiner* — Benjamin Osterhout
(74) *Attorney, Agent, or Firm* — Ked & Associates LLP

(57) ABSTRACT

A dishwasher is provided in which heights of basket(s) of a rack assembly may be easily changed. The dishwasher may include a frame configured to be inserted into and withdraw from a washing tub and plurality of basket positioning device configured to receive and support basket(s) at different heights.

31 Claims, 12 Drawing Sheets

(A)

(B)

DISHWASHER AND RACK ASSEMBLY THEREFOR

This application claims priority to Korean Patent Application No. 10-2006-138626 filed in Korea on Dec. 29, 2006, the entire contents of which is hereby incorporated by reference.

BACKGROUND

1. Field

A dishwasher and a rack assembly therefor are disclosed herein.

2. Background Art

In general, a dishwasher is an apparatus that washes away food residue attached to dishware, such as bowls, spoons, chopsticks, and various culinary tools (hereinafter, referred to collectively as "dishware") using a detergent and wash water. The dishwasher may include a washing tub or space having a cavity of a predetermined size. One or more rack assembly, in which dishes may be placed, may be provided and be configured to be inserted into and withdrawn from the washing tub. A wash water spraying apparatus that sprays wash water onto the dishes placed in the rack assembly is provided in the washing tub. In the dishwasher having the above structure, after the dishes are placed in the one or more rack assembly, the one or more rack assembly is pushed inside of the washing tub. Then, the wash water spraying apparatus sprays the wash water at high pressure onto the one or more rack assembly to wash the dishes using the wash water.

Among the dishes, a plurality of cutleries and culinary tools that are narrow and long may be provided in the one or more rack assembly in a line separated from each other. The cutleries may include a knife, a spoon, and a fork. The culinary tools may include a ladle, a kitchen knife, and a turner.

However, in the related art dishwasher, it is not possible to or it is very difficult to change the heights of the one or more rack assembly. Therefore, there are limitations on controlling the heights of the one or more rack assembly in accordance with the kinds of the dishes to be washed and the space efficiency of the washing tub deteriorates.

BRIEF DESCRIPTION OF THE DRAWINGS

Embodiments will be described in detail with reference to the following drawings in which like reference numerals refer to like elements, and wherein.

DETAILED DESCRIPTION

Figure 1:
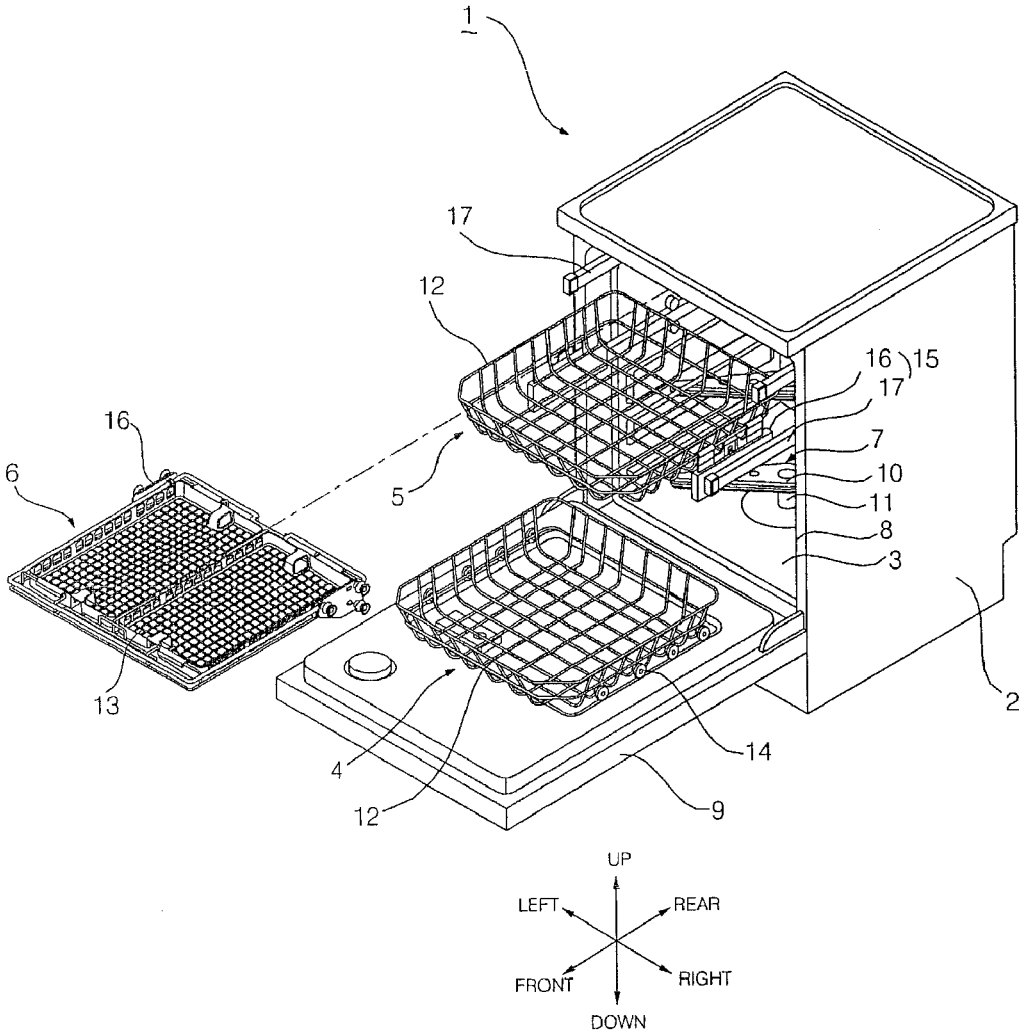
FIG. 1 is a front perspective view of a dishwasher according to an embodiment.

Reference will now be made in detail to embodiments, examples of which are illustrated in the accompanying drawings. Wherever possible, like reference numerals have been used throughout the drawings to refer to the same as like parts.

Figure 2:
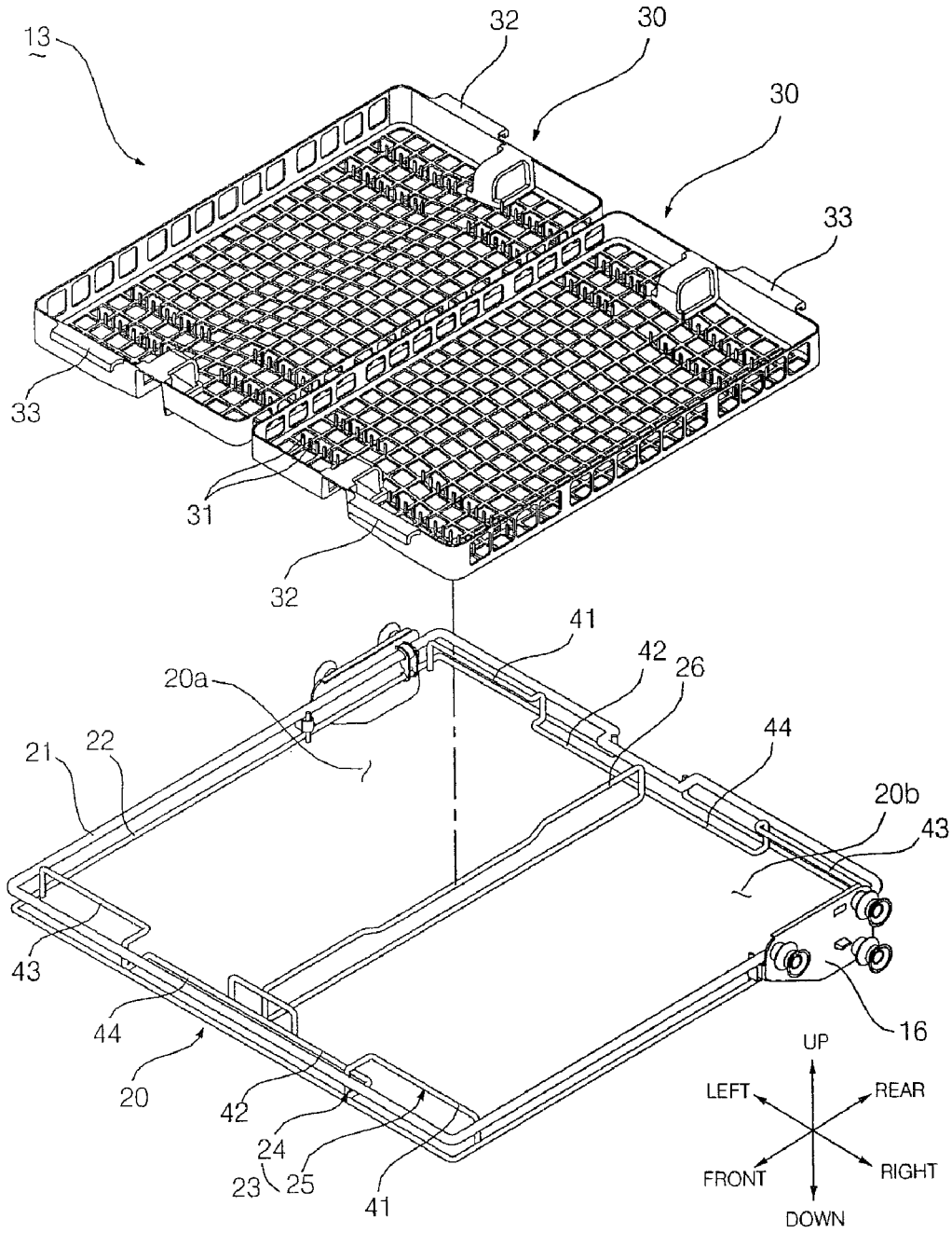
FIG. 2 is an exploded perspective view of a frame and baskets of a rack assembly of the dishwasher of FIG. 1.
Figure 3:
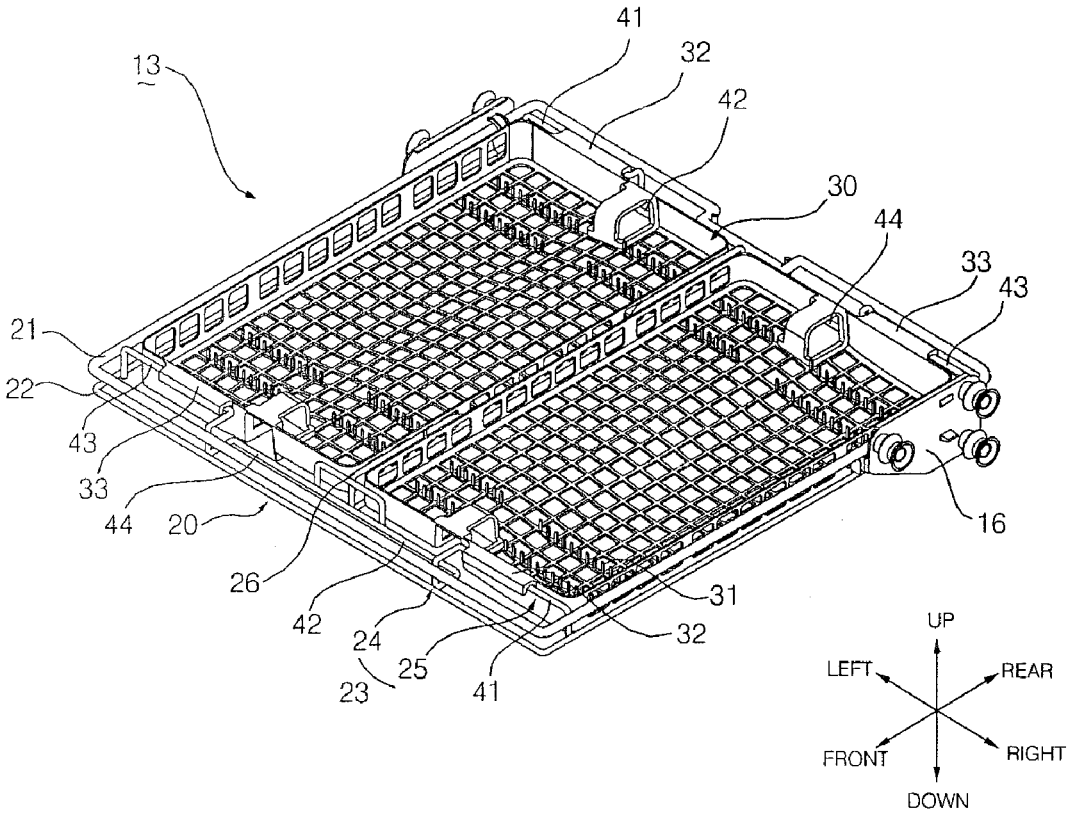
FIG. 3 is a perspective view illustrating a state in which the baskets illustrated in FIG. 2 are provided in the frame in a first position.
Figure 4:
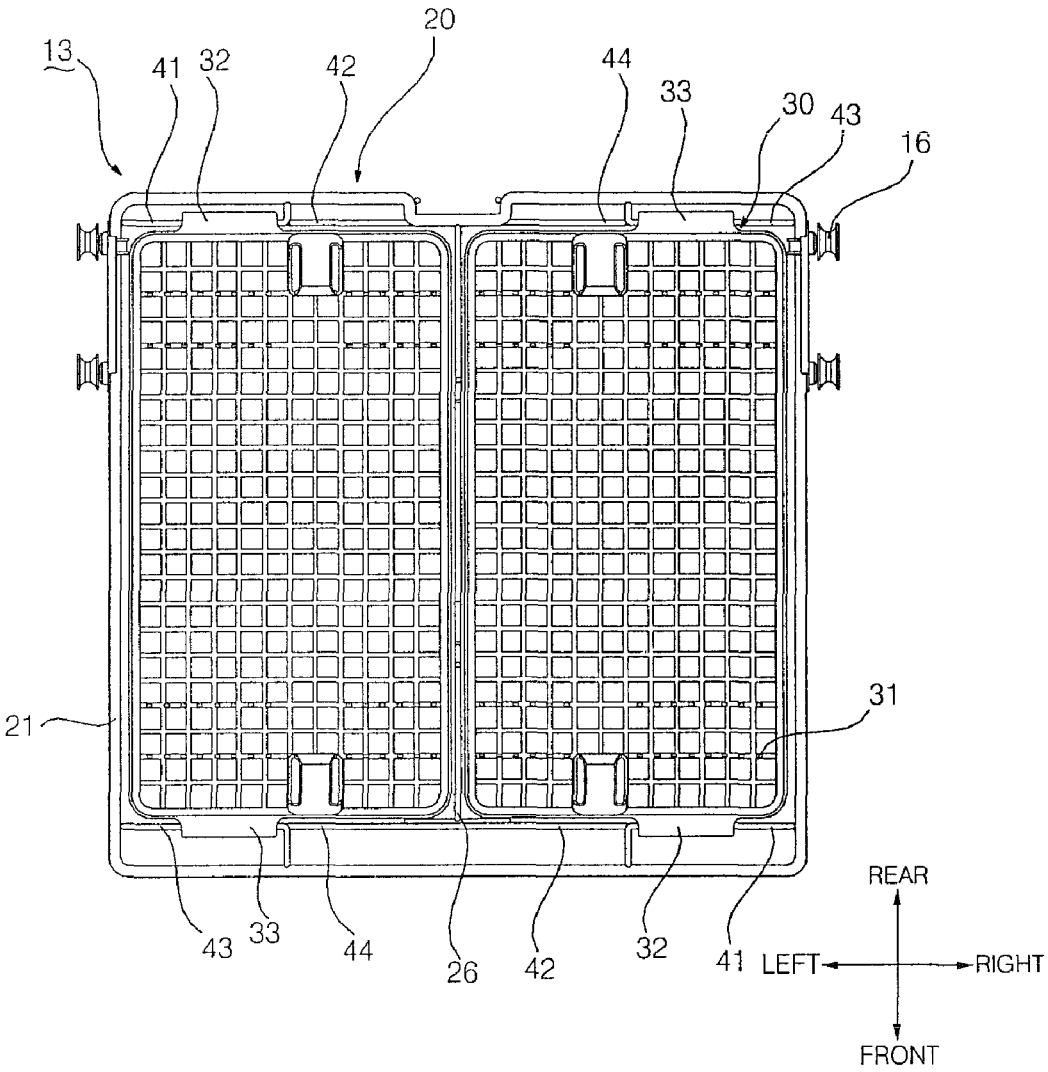
FIG. 4 is a plan view of the baskets and the frame illustrated in FIG. 3.
Figure 5:
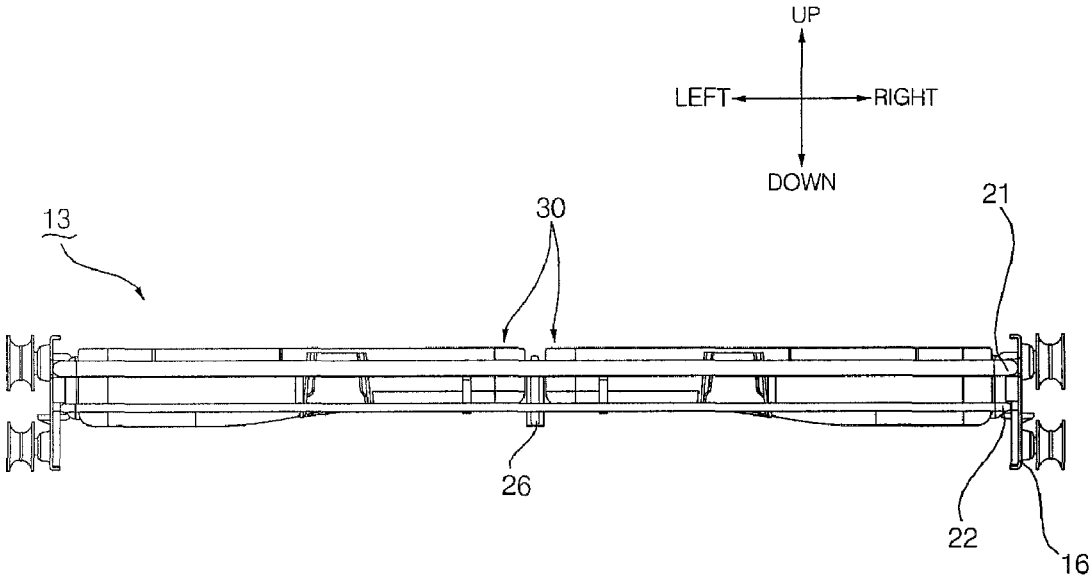
FIG. 5 is a front view of the baskets and the frame illustrated in FIG. 3.
Figure 6:
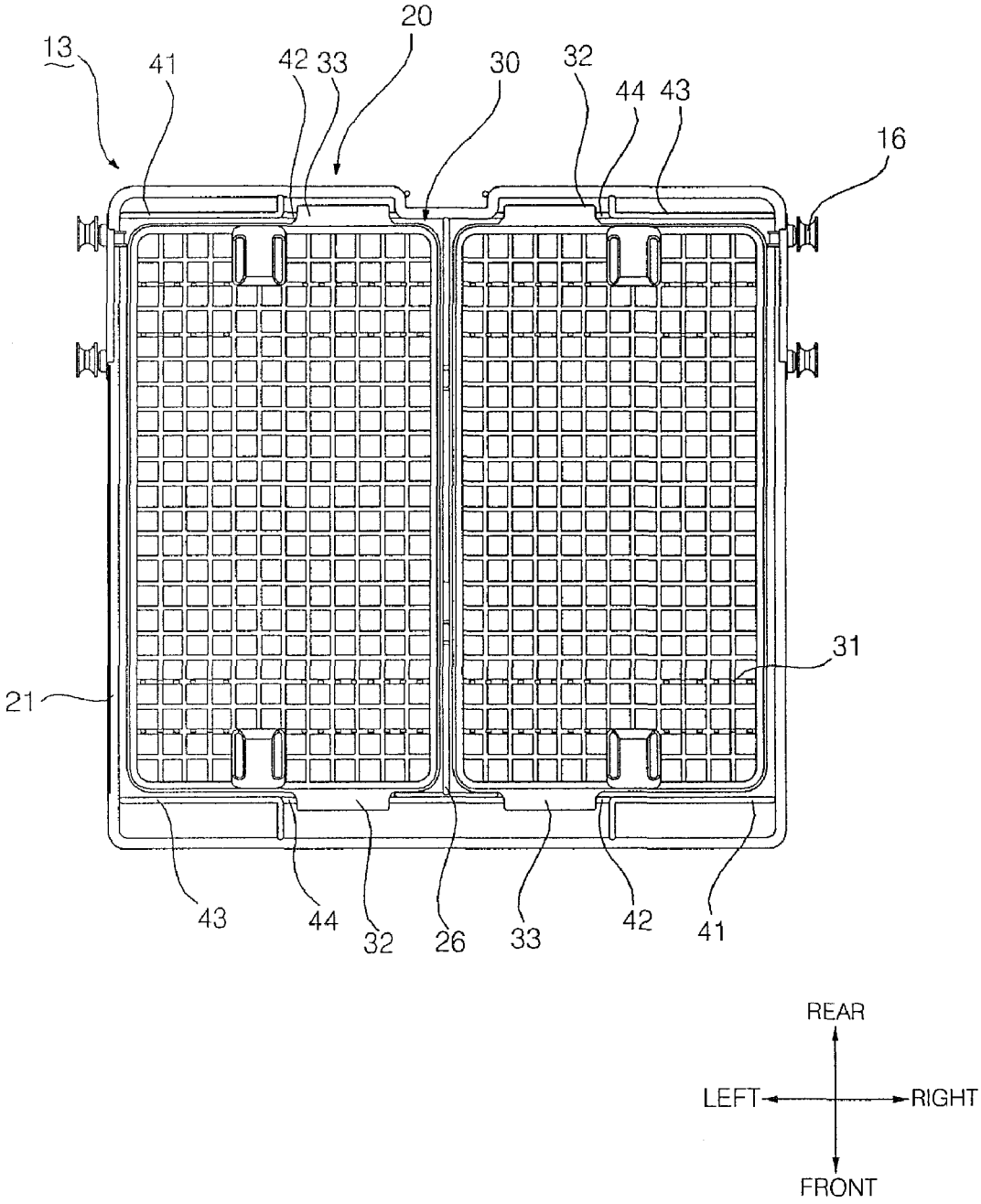
FIG. 6 is a plan view illustrating a state in which the baskets illustrated in FIG. 2 are provided in the frame in a second position.
Figure 7:
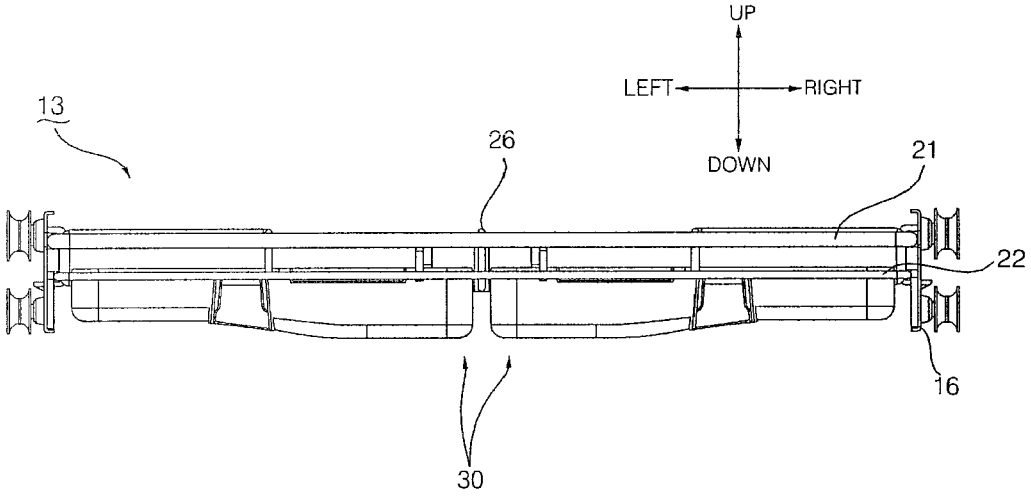
FIG. 7 is a front view of the baskets and the frame illustrated in FIG. 6.
Figure 8A:
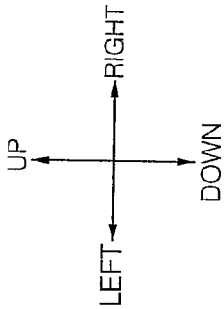
FIGS. 8A and 8B are front views illustrating a state in which the baskets illustrated in FIG. 2 are provided in the frame in first and second positions, respectively.
Figure 8A:
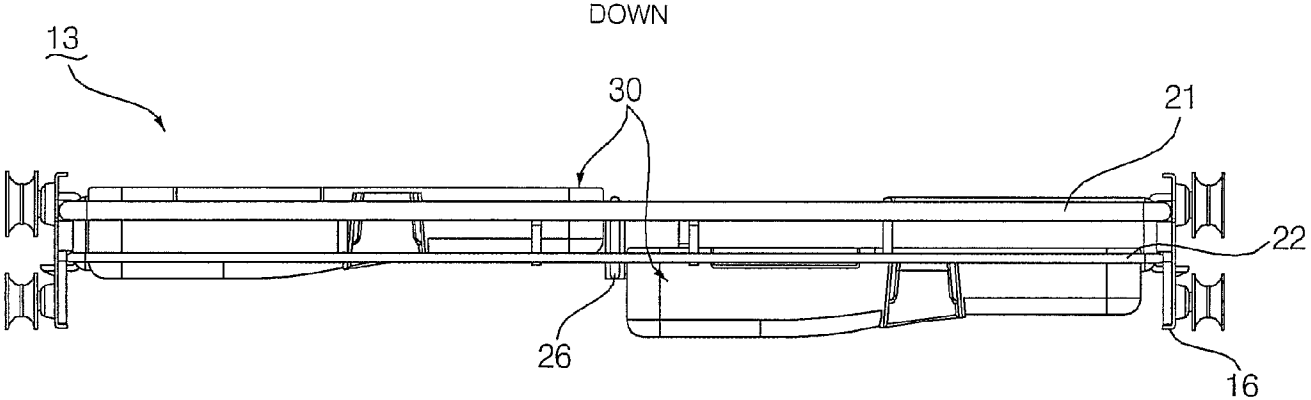
Figure 8B:
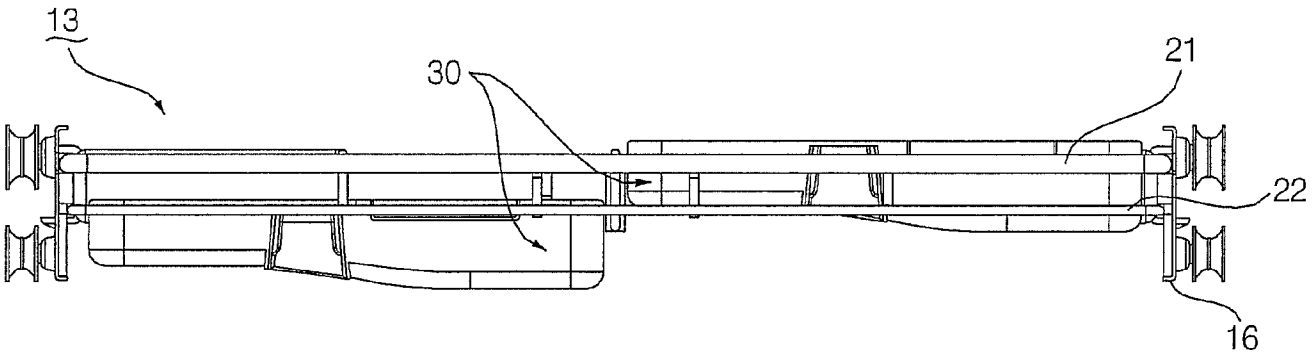

FIG. 1 is a front perspective view of a dishwasher according to an embodiment. FIG. 2 is an exploded perspective view of a frame and baskets of a rack assembly of the dishwasher of FIG. 1. FIG. 3 is a perspective view illustrating a state in which the baskets illustrated in FIG. 2 are provided in the frame in a first position. FIG. 4 is a plan view of the baskets and the frame illustrated in FIG. 3. FIG. 5 is a front view of the baskets and the frame illustrated in FIG. 3. FIG. 6 is a plan view illustrating a state in which the baskets illustrated in FIG. 2 are provided in the frame in a second position. FIG. 7 is a front view of the baskets and the frame illustrated in FIG. 6. FIGS. 8A and 8B are front views illustrating a state in which the baskets illustrated in FIG. 2 are provided in the frame in the first and second positions, respectively.

Referring to FIG. 1, a dishwasher 1 may include a washing tub or space 3 provided in a cabinet 2 and having a cavity of a predetermined size, one or more rack assemblies 4, 5, and 6 that are configured to be inserted into and withdrawn from in the washing tub 3 and in which dishes may be placed, and a was water spraying apparatus 7 provided in the washing tub 3 to spray wash water onto the dishes placed in the rack assemblies 4, 5, and 6. An entrance or opening 8 may be formed on the front surface of the cabinet 2 and the washing tub 3, and a door 9 that opens and closes the entrance 8 may be rotatably attached in the cabinet 2. The door 9 may be opened and closed in a drop-down manner.

The wash water spraying apparatus 7 sprays the wash water onto the dishes placed in the rack assemblies 4, 5, and 6. The wash water spraying apparatus 7 may include a pump (not shown) provided between the cabinet 2 and the washing tub 3 to pump the wash water, a plurality of nozzles 10 that spray the wash water pumped by the pump onto the dishes, and a wash water channel 11 formed between the nozzles 10 and the pump. The nozzles 10 may be provided at a lower side and/or the upper side of the rack assemblies 4, 5, and 6.

The embodiment of FIG. 1 shows three rack assemblies 4, 5, and 6 arranged in a column fashion in the washing tub 3. That is, the first rack assembly 4 and the second rack assembly 5 may be provided, respectively, in a lower portion and in a middle portion of the washing tub 3, and the third rack assembly 6 may be provided in an upper portion of the washing tub 3. Large dishware, such as dishes and bowls, may be provided in the first rack assembly 4 and the second rack assembly 5 and smaller dishware, such as cutleries and culinary tools, may be provided in the third rack assembly 6. However, one or more rack assemblies may be provided in the washing tub in accordance with the design conditions of the dishwasher and the kinds of dishes to be placed in the rack assemblies may vary.

The rack assemblies 4, 5, and 6 may include racks 12 and 13, in which the dishes are placed, and movement guides 14 and 15 that movably support the racks 12 and 13 to move in a forward and backward direction. The racks 12 and 13 may be in the form of a grill so that the wash water sprayed from the wash water spraying apparatus 7 may be effectively transmitted to the dishes therein. The racks 12 of the first rack assembly 4 and the second rack assembly 5 may be formed, for example, of metal rods in the form of the grill. The rack 13 of the third rack assembly 6 may include baskets 30 molded in the form of a grill. The movement guide 14 of the first rack assembly 4 may include a plurality of wheels rotatably provided under the rack 12 so that the rack 12 moves along internal surfaces of the door 9 and the washing tub 3. The movement guides 15 of the second rack assembly 5 and the third rack assembly 6 may include rollers 16 provided on both sides of the racks 12 and 13 and guide rails 17 formed on both sides of the washing tub 3 to guide the movement of the rollers 16. Alternatively, the guide rails 17 may be formed on both sides of the racks 12 and 13 and the rollers 16 may be provided on both sides of the washing tub 3.

Referring to FIGS. 1 and 2, the rack 13 of the third rack assembly 6 may include a frame 20 configured to be inserted into and withdrawn from the washing tub 3 by the movement guide 15 and baskets 30 that are detachably mounted in the frame 20 and in which a plurality of dish holders 31 that support the cutleries and the culinary tools may be formed. Referring to FIGS. 2 and 3, the frame 20 may be, for example, a rectangular frame formed of, for example, steel rods. The frame 20 may include an upper frame 21 and a lower frame 22, both of which may be rectangular, separated from each other in an up and down direction, connecting frames 23 that connect the upper frame 21 and the lower frame 22 to each other and that include a plurality of settling units or baskets positioning devices 25 in or on which the baskets 30 are supported, and a dividing frame 26 that divides the space limited by the upper frame 21 and the lower frame 22 into a plurality of spaces. The rollers 16 may be provided on both sides of the upper frame 21 and the lower frame 22 to correspond to the guide rails 17 formed on the washing tub 3.

The dividing frame 26 may divide the space limited by the frame 20 into a plurality of basket settling or basket receiving spaces 20*a* and 20*b*. The dividing frame 26 may be formed of, for example, double frames separated from each other in an up and down direction to correspond to the upper frame 21 and the lower frame 22. The baskets 30 may be sized to correspond to the sizes of the basket receiving spaces 20*a* and 20*b* and may be detachably provided in the basket receiving spaces 20*a* and 20*b*. Further, at least two of the basket receiving spaces 20*a* and 20*b* may have the same shape. In the case that the baskets 30 provided in the basket receiving spaces 20*a* and 20*b* have the same shape, they can be exchanged with each other and the baskets 30 commonly used. One embodiment will be disclosed herein below in which the space limited by the frame 20 is divided by the dividing frame 26 into side-by-side basket receiving spaces and the divided spaces of the frame 20 have the same shape. That is, the basket receiving spaces 20*a* and 20*b* may include a left basket receiving space 20*a* formed on a left side of the space limited by the frame 20 and the dividing frame 26 and a right basket receiving space 20*b* formed on the right side of the space limited by the frame 20 and the dividing frame 26 to have the same shape as the shape of the left basket settling space 20*a*. Baskets 30 may be provided in each of the left basket receiving space 20*a* and the right basket receiving space 20*b*, respectively.

The connecting frames 23 may be provided on a front surface and a rear surface of the upper frame 21 and the lower frame 22 to face each other. The connecting frames 23 may include a plurality of connecting devices or units 24, upper and lower parts of which are connected to the upper frame 21 and the lower frame 22, respectively, and supporting devices or units 25 that protrude from the connecting devices 24 to the insides of the basket receiving spaces 20*a* and 20*b* and on which the baskets 30 are supported.

The supported devices 25 may include at least one of supporting protrusions or supporting grooves in which the baskets 30 are supported. Hereinafter, an embodiment will be discussed for which the supporting devices 25 include supporting protrusions. That is, both ends of the supporting devices 25 may be connected to the two connecting devices 24 and the intermediate parts of the supporting devices 25 may extendedly protrude to the insides of the basket receiving spaces 20*a* and 20*b*. The supporting devices 25 may be formed in both the left basket receiving space 20*a* and the right basket receiving space 20*b*.

The supporting device 25 of the left basket receiving space 20*a* may include first, second, third, and fourth supporting protrusions 41, 42, 43, and 44 that protrude to the inside of the right basket receiving space 20*a*. The first and second supporting protrusions 41 and 42 may be formed in the connecting frame 23 provided on a rear surface of the frame 20. The third and fourth receiving protrusions 43 and 44 may be formed in the connecting frame 23 provided on a front surface of a frame 20 to face the first and second receiving protrusions 41 and 42. That is, the first receiving protrusion 41 and the third receiving protrusion 43 may be provided on the front surface and the rear surface of facing surfaces of the frame 20 so as to face each other. The second supporting protrusion 42 and the forth settling protrusion 44 may be provided in the front surface and the rear surface of the facing surfaces of frame 20 to face each other. Therefore, the first supporting protrusion 41 and the second supporting protrusion 42 may be provided in the connecting frame 23 provided on the front surface of the frame 20 from side to side to be separated from each other. The third supporting protrusion 43 and the fourth supporting protrusion 44 may be provided in the connecting frame 23 provided on the rear surface of the frame 20 frame in a side-to-side direction separated from each other.

The first and third supporting protrusions 41 and 43 may have the same height and the second and fourth supporting protrusions 42 and 44 may be positioned lower than the first and third supporting protrusions 41 and 43. However, when the first and third supporting protrusions 41 and 43 are higher than the second and fourth supporting protrusions 42 and 44, the first and third supporting protrusions 41 and 43 or the second and fourth supporting protrusions 42 and 44 may have different heights.

The supporting devices 25 of the left basket receiving space 20*a* and the right basket receiving space 20*b* may be symmetrical with respect to each other. Hereinafter, an embodiment will be discussed in which the supporting devices 25 of the left basket receiving space 20*a* and the right basket receiving space 20*b* may be symmetrical with respect to each other and the dividing frame 26. That is, the supporting devices 25 of the right basket receiving space 20*b* may include first, second, third, and fourth supporting protrusions 41, 42, 43, and 44 so that front and rear and right and left are reversed with respect to the first, second, third, and fourth supporting protrusions 41, 42, 43, and 44 of the left basket receiving space 20*a*. Therefore, in the supporting devices 25 of the left basket receiving space 20*a*, the first supporting protrusions 41 may be provided in the rear on the left side, the second supporting protrusions 42 may be provided in the rear on the right side, the third supporting protrusions 43 may be provided in front on the left side, and the fourth supporting protrusions 44 may be provided in front on the right side. However, in the supporting devices 25 of the right basket receiving space 20*b*, the first supporting protrusions 41 may be provided in front on the right side, the second supporting protrusions 42 may be provided in front on the left side, the third supporting protrusions 43 may be provided in the rear on the right side, and the fourth supporting protrusions 44 may be provided in the rear on the left side.

Referring to FIGS. 2 and 3, the baskets 30 may be basket shaped molds in which the cutleries and the culinary tools may be accommodated. The baskets 30 may be detachably provided in the basket receiving spaces 20*a* and 20*b* formed in the frame 20. A plurality of dish holders 31 into which the cutleries and the culinary tools may be inserted to be fixed thereto may be formed on the internal bottom surfaces of the baskets 30. The dish holders 31 may be provided in a line separated from each other by a predetermined distance so that the cutleries and the culinary tools may be inserted into a center of the dish holders 31 to be fixed thereto. The dish holders 31 may be integrally molded on the internal bottom surfaces of the baskets 30.

Further, the baskets 30 may include a plurality of supported devices 32 and 33 selectively supported on the first, second, third, and fourth supporting protrusions 41, 42, 43, and 44 in a first or a second position. The supported devices 32 and 33 may include a plurality of supported protrusions selectively supported or positioned on the first second, third, and fourth supporting protrusions 41, 42, 43, and 44 in accordance with positions of the baskets 30 provided in the basket receiving spaces 20*a* and 20*b*. That is, the supported devices 32 and 33 may include the first supported protrusions 32 supported or positioned on the first supporting protrusions 41 in the first position of the baskets 30 and supported or positioned on the fourth supporting protrusions 44 in the second position of the baskets 30 and the second supported protrusions 33 supported or positioned on the third supporting protrusions 43 in the first position of the basket 30 and supporting in the second supporting protrusions 42 in the second position of the baskets 30.

Therefore, the baskets 30 may be positioned high when the baskets 30 are provided in the basket receiving spaces 20*a* and 20*b* of the frame 20 in the first position and low when the baskets 30 are provided in the basket receiving spaces 20*a* and 20*b* of the frame 20 in the second position. In addition, the first position and the second position of the baskets 30 may be rotated by 180°. That is, the baskets 30 may be horizontally rotated by 180° to be provided in one of the first and second positions.

The operation of the dishwasher according to an embodiment having the above-described structure will be described hereinafter.

First, the door 9 may be opened to open the entrance 8 formed on the front surface of the dishwasher 1 and the rack assemblies 4, 5, and 6 taken out from inside of the washing tub 3. Various kinds of dishes to be washed may be placed in the rack assemblies 4, 5, and 6. Then, the rack assemblies 4, 5, and 6 may be pushed into the washing tub 3 and the door 9 closed to close the entrance 8. After the dishes are accommodated in the washing tub 3 as described above, the dishwasher 1 may be operated to wash the dishes placed in the rack assemblies 4, 5, and 6 using the wash water from the wash water spraying apparatus 7.

As illustrated in FIG. 1, when the rack assemblies 4, 5, and 6 of the dishwasher 1 are provided and the third rack assembly 6 in an uppermost position in the washing tub 3 includes the rack 13 that washes the cutleries and the culinary tools, the cutlery and the culinary tools may be washed after being inserted into the dish holders 31 formed in the baskets 30 of the third rack assembly 6. The baskets 30 may be provided in the frame 20 in the first position when low dishes, such as the cutleries, are placed therein and in the second position lower than the first position when smaller dishes, such as the culinary tools, are placed therein.

Referring to FIGS. 4 and 5, when the baskets 30 are provided in the frame 20 in the first position, the first supported protrusions 32 of the baskets 30 are supported or positioned on the first supporting protrusions 41 of the frame 20 and the second supported protrusions 33 of the baskets 30 are supported or positioned on the third supporting protrusions 43 of the frame 20. Since the first and third supporting protrusions 41 and 43 are higher than the second and fourth supporting protrusions 42 and 44, the baskets 30 are provided on the frame 20. Therefore, when the smaller cutleries are provided in the baskets 30, the baskets 30 are provided in the first position so that the lower spaces of the baskets 30 may be used.

Referring to FIGS. 6 and 7, when the baskets 30 are provided in the frame 20 in the second position, the first supported protrusions 32 of the baskets 30 are supported or positioned on the fourth supporting protrusions 44 of the frame 20 and the second supported protrusions 33 of the baskets 30 are supported or positioned on the second supporting protrusions 42 of the frame 20. Since the second and fourth supporting protrusions 42 and 44 are lower than the first and third supporting protrusions 41 and 43, the baskets 30 are provided under the frame 20. Therefore, larger culinary tools may be provided in the baskets 30 so that the culinary tools can be washed.

As described above, the heights of the baskets 30 may be controlled by rotating the baskets 30 in the basket receiving spaces 20*a* and 20*b* of the frame 20 by 180° or by exchanging the baskets 30 provided in the left basket receiving space 20*a* and the right basket receiving space 20*b* with each other. Therefore, the heights of the baskets 30 may be easily controlled or changed and, when dishes having various heights are washed, the internal space of the washing tub 3 may be effectively used.

Referring to FIGS. 8A and 8B, the baskets 30 may be provided in the left basket receiving space 20*a* in one of the first and second positions and in the right basket receiving space 20*b* in the other of the first and second positions. That is, since the basket 30 of the left basket receiving space 20*a* illustrated in FIG. 8A and the basket 30 of the right basket receiving space 20*b* illustrated in FIG. 8B are provided in the first position, the cutleries may be accommodated to be washed. Since the basket 30 of the right basket receiving space 20*b* illustrated in FIG. 8A and the basket 30 of the left basket receiving space 20*a* illustrated in FIG. 8B may be provided in the second position, the culinary tools may be accommodated to be washed. Since the baskets 30 are provided in the frame 20 in different positions as described above, the cutleries and the culinary tools may be simultaneously washed as occasion demands.

Further, as shown in FIGS. 8A and 8B, the baskets 30 may have a curved bottom. The curved bottom of the baskets 30 allows dishware of varying sizes to be accommodated therein.

Figure 9:
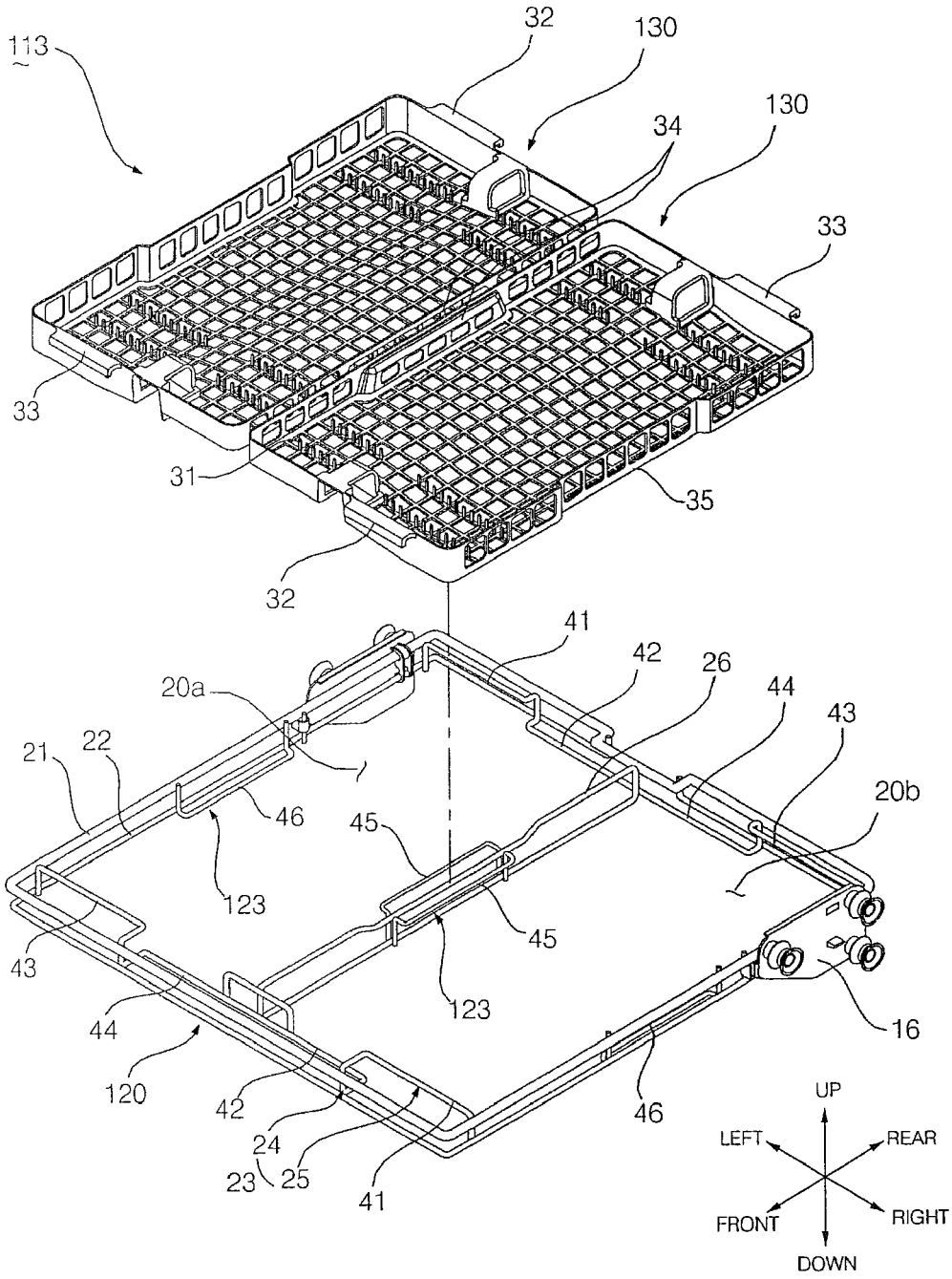
FIG. 9 is an exploded perspective view illustrating a frame and baskets in a rack assembly of a dishwasher according to another embodiment.
Figure 10:
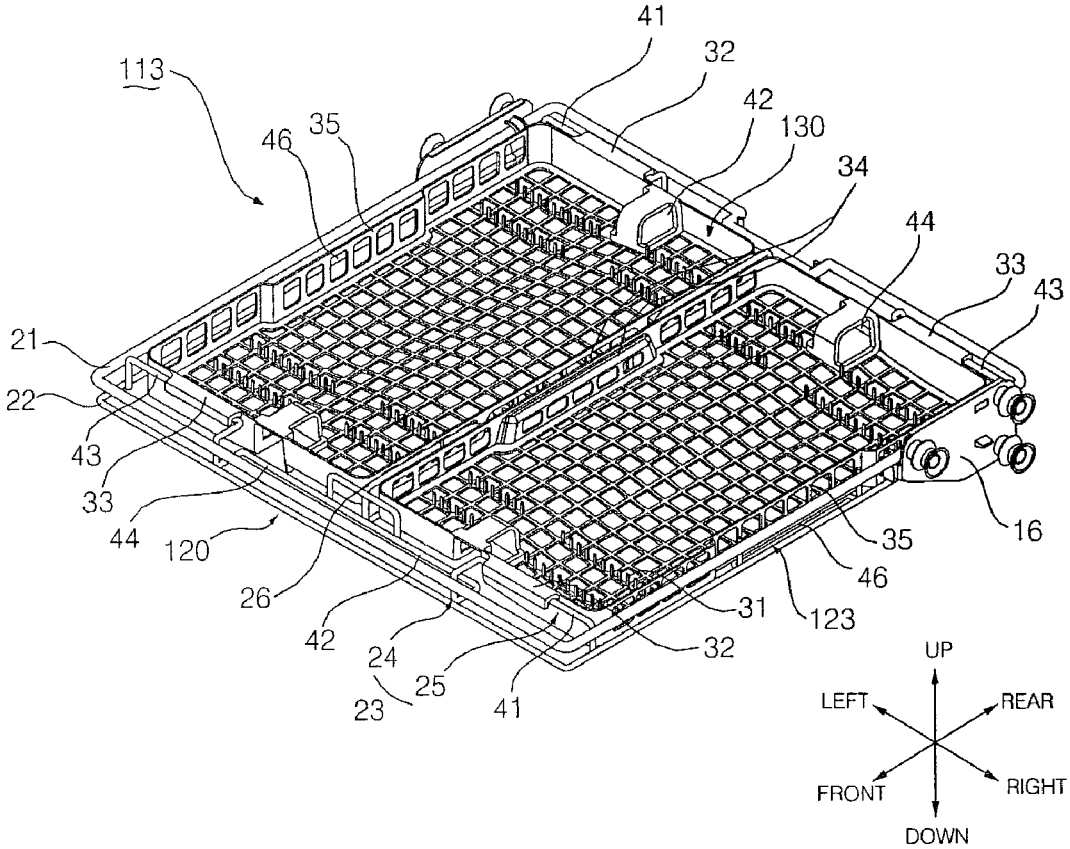
FIG. 10 is a perspective view illustrating a state in which the baskets illustrated in FIG. 9 are provided in the frame in a first position.
Figure 11:
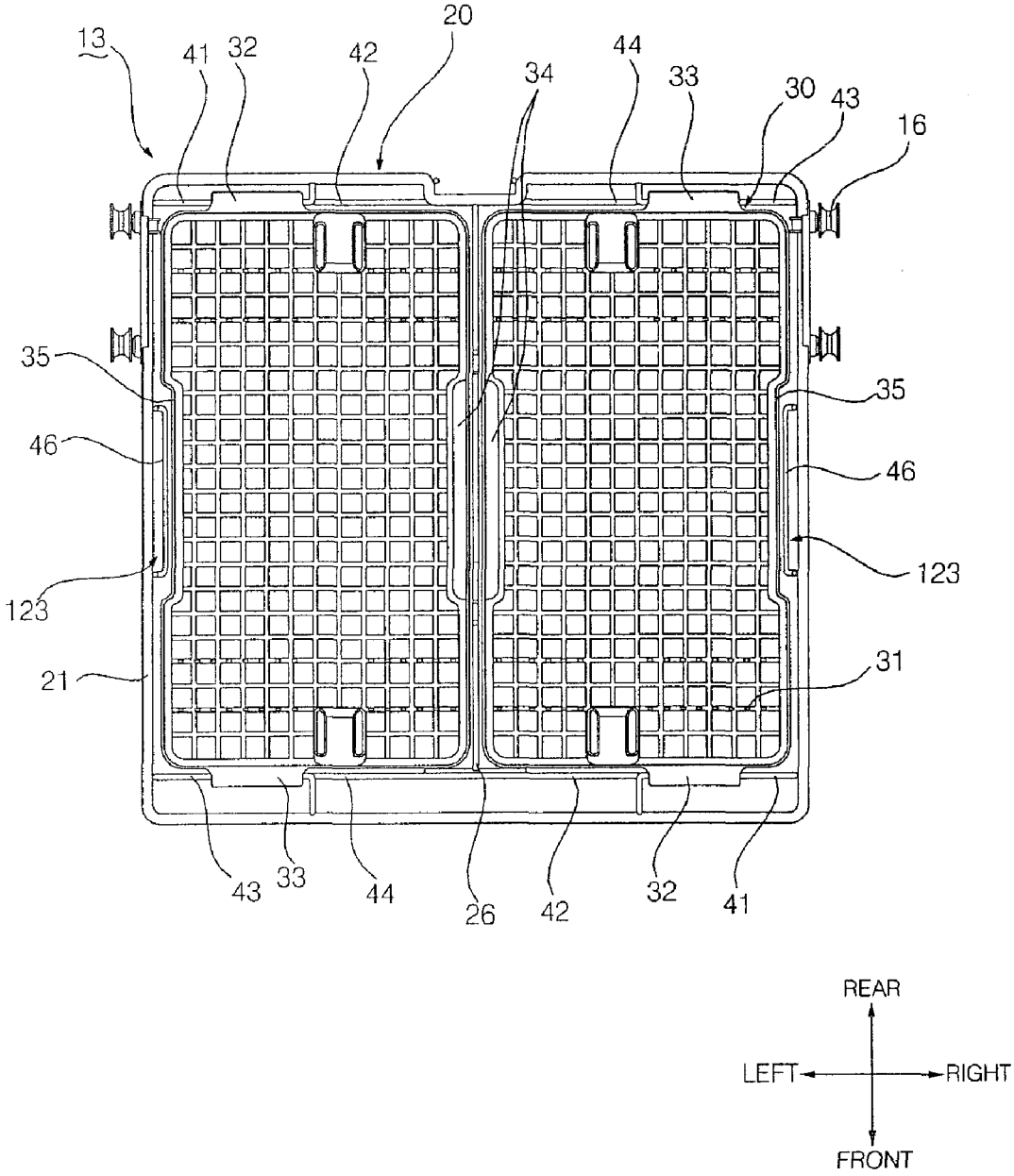
FIG. 11 is a plan view of the baskets and the frame illustrated in FIG. 10.
Figure 12:
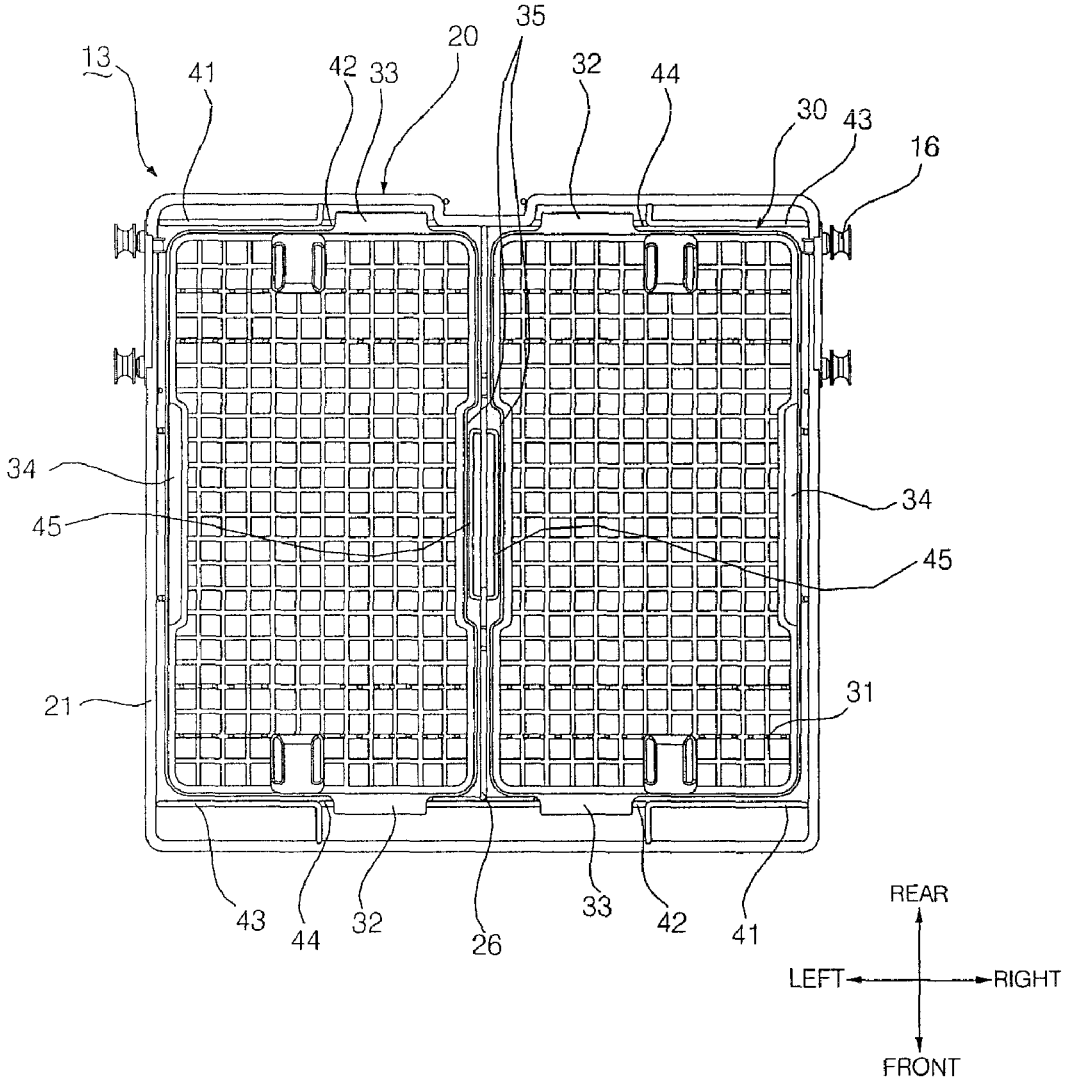
FIG. 12 is a plan view illustrating a state in which the baskets illustrated in FIG. 9 are provided in the frame in a second position.

FIG. 9 is an exploded perspective view illustrating a frame and baskets in a rack assembly of a dishwasher according to another embodiment. FIG. 10 is a perspective view illustrating a state in which the baskets illustrated in FIG. 9 are provided in a frame in the first position. FIG. 11 is a plan view of the baskets and the frame illustrated in FIG. 10. FIG. 12 is a plan view illustrating a state in which the baskets illustrated in FIG. 9 are provided in the frame in a second position. In FIGS. 9 to 12, like reference numerals have been used to indicate like elements to the dishwasher illustrated in FIGS. 1 to 8. Hereinafter, only reference numerals different from the embodiment of FIGS. 1 to 8 will be described.

The difference between the dishwasher according to this embodiment and the dishwasher illustrated in FIGS. 1 to 8 lies in frame 120 and baskets 130 of rack assembly 113. That is, in the rack assembly 113 illustrated in FIGS. 9 to 12, connecting frames 123 having fifth supporting protrusions 45 and sixth supporting protrusions 46 may be formed to face each other on facing surfaces of the frame 120 where the first and second supporting protrusions 41 and 42 and the third and fourth supporting protrusions 43 and 44 are not formed and supported devices 34 may be further formed on sides of the baskets 30 to be selectively supported or positioned on the fifth supporting protrusions 45 and the sixth settling protrusions 46 in accordance with the first and second positions of the baskets 30.

In the left basket receiving space 20*a* of the frame 20, the fifth supporting protrusion 45 are provided in the dividing frame 26 and the sixth supporting protrusions 46 are provided on the left sides of the upper frame 21 and the lower frame 22 to face the fifth supporting protrusions 45. The fifth supporting protrusions 45 are higher than the sixth supporting protrusions 46. The fifth supporting protrusions 45 have the same height as the height of the first and third supporting protrusions 41 and 43 and the sixth supporting protrusions 46 have the same height as the height of the second and fourth supporting protrusions 42 and 44.

In the right basket receiving space 20*b* of the frame 20, the fifth and sixth supporting protrusions 45 and 46 are provided to face the fifth and sixth supporting protrusions 45 and 46 of the left basket receiving space 20*a* based on the dividing frame 26. That is, in the right basket receiving space 20*b*, the sixth supporting protrusions 46 are provided in the dividing frame 26 and the fifth supporting protrusions 45 are provided on the right side of the frame 20 to face the sixth supporting protrusions 46.

The supported devices 34 of the baskets 30 may include supported grooves that are provided in the basket receiving spaces 20*a* and 20*b* in the first or second position so that the fifth supporting protrusions 45 and the sixth supporting protrusions 46 may be selectively inserted into the supported grooves 34. The supported grooves 34 are formed so that the top surfaces of the supported grooves 34 are closed by one of the left surfaces and the right surfaces of the baskets 30 and that the supported grooves 34 may be locked by the top surfaces of the supported grooves 34 after one of the fifth and sixth supporting protrusions 45 and 46 is inserted into the supported grooves 34.

On the other hand, on the sides where the supported grooves 34 are not formed between the left surfaces and the right surfaces of the baskets 30, avoiding grooves 35 may be formed to correspond to the supported grooves 34 so that interference with the fifth and sixth supporting protrusions 45 and 46 may be avoided. Therefore, when the position of the baskets 30 is changed, the supporting protrusions that are not inserted into the supported grooves 34 between the fifth and sixth supporting protrusions 45 and 46 are inserted into the avoiding grooves 35.

Referring to FIGS. 10 and 11, when the baskets 30 may be provided in the frame 20 in the first position, the first supported protrusions 32 may be settled in the first supporting protrusions 41 and the second supported protrusions 33 are settled in the third supporting protrusions 43. The fifth supporting protrusions 45 may be inserted into and locked by the supported grooves 34 and the sixth supporting protrusions 46 may be provided in the avoiding grooves 35. Since the first, third, and fifth supporting protrusions 41, 43, and 45 are higher than the second, fourth, and sixth supporting protrusions 42, 44, and 46, the baskets 30 may be provided on the frame 20.

Referring to FIG. 12, when the baskets 30 are provided in the frame 20 in the second position, the first supported protrusions 32 may be positioned on the fourth supporting protrusions 44 and the second supported protrusions 33 may be positioned on the second supporting protrusions 42. The sixth supporting protrusions 46 are inserted into and locked by the supported grooves 34 and the fifth supporting protrusions 45 may be provided in the avoiding grooves 35. Since the second, fourth, and sixth supporting protrusions 42, 44, and 46 are lower than the first, third, and fifth supporting protrusions 41, 43, and 45, the baskets 30 are provided under the frame 20. As described above, according to this embodiments, since the baskets 30 are supported least three points within the basket receiving spaces 20*a* and 20*b* of the frame 20, the baskets 30 may be stably provided in comparison with the case where the baskets 30 are supported at two points.

The basket positioning devices according to embodiments disclosed herein may be applied to one-column rack assemblies or two-column rack assemblies, as well as three-column rack assemblies. In addition, the basket positioning devices according to embodiments disclosed herein may have various structures and various heights.

As described above, in the dishwasher according to embodiments disclosed herein, since the baskets are provided to have different heights in the first and second positions in the frame of the rack assemblies, the heights of the baskets of the rack assemblies are easily controlled or changed. In addition, in the dishwasher according to embodiments disclosed herein, since the heights of the baskets of the rack assemblies are controlled, dishes of various sizes may be washed and the space efficiency of the washing tub improved.

Embodiments disclosed herein provide a dishwasher in which heights of parts of rack assemblies on which dishes are placed are easily controlled so that dishes of various sizes may be selectively washed and that space efficiency of the washing tub improved. In accordance with one embodiment disclosed herein, there is provided a dishwasher that includes a frame drawably provided in a washing tub to include first, second, third, and fourth settling units and a first position settled in the first and third settling units or a second position settled in the second and fourth settling units to be lower than the first position. A space limited by the frame may be divided into a plurality of spaces and the first, second, third, and fourth settling units formed in the divided spaces of the frames respectively. At least two of the divided spaces of the frame may have the same shape and the first, second, third, and fourth settling units formed in the divided spaces of the same shape may be symmetrical to each other.

The first position and the second position may be rotated by 180°. In addition, the first settling units and the third settling units may be formed on facing surfaces of the frame to face each other and the second settling units and the fourth settling units may be formed on facing surfaces of the frame to face each other. In addition, the first settling units and the second settling units may be formed on one of surfaces of the frame to be separated from each other and the third settling units and the fourth settling units may be formed on surfaces where the first and second settling units are not formed among the surfaces of the frame to be separated from each other.

The first, second, third, and fourth settling units may include at least one of settling protrusions and settling grooves in which the baskets are settled. The baskets may include a plurality of supporting units selectively settled in the first and third settling units and the second and fourth settling units in accordance with the first position or the second position.

The first, second, third, and fourth settling units may include first, second, third, and fourth settling protrusions in which the supporting units are settled and the supporting units may include a plurality of supporting grooves formed in the baskets so that the first and third settling protrusions or the second and fourth settling protrusions are inserted into the supporting grooves. Avoiding grooves may be formed in parts corresponding to settling protrusions that are not inserted into the supporting grooves in the baskets to avoid interference with the settling protrusions that are not inserted into the supporting grooves. The supporting units may include first supporting units settled in the first settling units in the first position of the baskets and settled in the fourth settling units in the second position of the baskets and second supporting units settled in the third settling units in the first position of the baskets and settled in the second settling units in the second position of the baskets.

The first and second settling units and the third and fourth settling units may be formed to face the facing surfaces of the frame. The first and third settling units may have the same height and the second and fourth settling units may be lower than the first and third settling units and have the same height. Fifth settling units and sixth settling units having different heights may be formed on facing surfaces where the first and second settling units and the third and fourth settling units are not formed among the facing surfaces of the frame and the baskets may further include third supporting units selectively settled in the fifth settling units and the sixth settling units in accordance with the first and second positions.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher, comprising:

a case having a dishwashing space disposed therein; and at least one rack assembly configured to receive dishware therein and to be inserted into and removed from the case, the rack assembly comprising:

a frame; and at least one basket configured to be supported by the frame at at least two height levels, wherein the at least one basket includes a first supporting device at each end thereof, wherein the frame includes a plurality of second supporting devices configured to mate with the plurality of first supporting devices, and wherein each of the plurality of second supporting devices includes an upper supporting portion and a lower supporting portion, the upper supporting portion being located vertically above the lower supporting portion, and the upper supporting portion and the lower supporting portion being located horizontally along a same straight line such that the height level of the at least one basket is changed by rotating the at least one basket 180 degrees.

2. The dishwasher of claim 1, wherein the at least one basket comprises at least two baskets configured to be supported on the frame adjacent to one another.

3. The dishwasher of claim 2, wherein a height level of each of the at least two baskets is changed by rotating the baskets 180 degrees.

4. The dishwasher of claim 2, wherein a height level of the at least two baskets is changed by reversing the positions of the two baskets.

5. The dishwasher of claim 2, wherein the at least two baskets are configured to be supported on the frame both at a high height level, both at a low height level, or one at a high height level and one at a low height level.

6. The dishwasher of claim 1, wherein the plurality of first supporting devices each comprise a supporting hook.

7. The dishwasher of claim 1, wherein the plurality of second supporting devices comprises a plurality of supporting bars.

8. The dishwasher of claim 1, wherein the upper supporting portion and the lower supporting portion of each second supporting device are integrally formed.

9. The dishwasher of claim 1, wherein the lower supporting portion extends from the upper supporting portion for each second supporting device.

10. The dishwasher of claim 1, wherein the upper supporting portion comprises a first supporting bar and the lower supporting portion comprises a second supporting bar connected to the first supporting bar by a substantially vertically extending connecting member.

11. A rack assembly for a dishwasher configured to receive dishware therein and to be inserted into and removed from a case of the dishwasher, the rack assembly comprising:

a frame; and at least one basket configured to be supported by the frame at least two height levels, wherein the at least one basket includes a first supporting device at each end thereof, wherein the frame includes a plurality of second supporting devices configured to mate with the plurality of first supporting devices, and wherein the plurality of second supporting devices includes a second supporting devices at each of two height levels such that the height level of the at least one basket is changed by rotating the at least one basket 180 degrees.

12. The rack assembly of claim 11, wherein the at least one basket comprises at least two baskets configured to be supported on the frame adjacent to one another.

13. The rack assembly of claim 12, wherein a height level of each of the at least two baskets is changed by rotating the baskets 180 degrees.

14. The rack assembly of claim 12, wherein a height level of the at least two baskets is changed by reversing the positions of the two baskets.

15. The rack assembly of claim 12, wherein the at least two baskets are configured to be supported on the frame both at a high height level, both at a low height level, or one at a high height level and one at a low height level.

16. The rack assembly of claim 11, wherein the plurality of first supporting devices each comprises a supporting hook.

17. The rack assembly of claim 11, wherein the plurality of second supporting devices comprise a plurality of supporting bars.

18. The dishwasher of claim 11, wherein the second supporting device at each of the two height levels comprises an upper supporting portion integrally formed with a lower supporting portion.

19. The dishwasher of claim 11, wherein the second supporting device at each of the two height levels comprises a lower supporting portion that extends from an upper supporting portion.

20. The dishwasher of claim 11, wherein the second supporting device at each of the two height levels comprises an upper supporting portion comprising a first supporting bar and a lower supporting portion comprising a second supporting bar connected to the first supporting bar by a substantially vertically extending connecting member.

21. A rack assembly for a dishwasher configured to receive dishware therein and to be inserted into and removed from a case of the dishwasher, the rack assembly comprising:

a frame; and a plurality of basket positioning devices configured to receive and support at least one basket at least two height levels, wherein a space limited by the frame is divided into a plurality of basket receiving spaces that extend lengthwise in the same direction, wherein at least two of the plurality of basket positioning devices are formed in each of the plurality of basket receiving spaces, respectively, and are configured to receive and support the at least one basket in the respective basket receiving space at the at least two height levels, and wherein the height level of the at least one basket is changed by shifting the at least one basket from one of the plurality of basket receiving spaces to the adjacent basket receiving space or by rotating the at least one basket 180 degrees.

22. The rack assembly of claim 21, wherein at least two of the plurality of basket receiving spaces have the same shape, and wherein the at least two of the plurality of basket positioning devices formed in each of the plurality of basket receiving spaces are formed symmetrical to each other.

23. The rack assembly of claim 22, wherein the at least two of the plurality of basket positioning devices formed in each of the plurality of basket receiving spaces are formed symmetrical to each other so as to face each other on opposite sides of the frame.

24. The rack assembly of claim 21, wherein the plurality of basket receiving spaces comprises two basket receiving spaces each provided with a plurality of basket positioning devices configured to hold and support a basket within the respective basket receiving space such that the baskets are adjacent to one another.

25. The dishwasher of claim 24, wherein the plurality of basket positioning devices is configured such that a height level of the two baskets is changed by reversing the positions of the two baskets.

26. The dishwasher of claim 24, wherein the plurality of basket positioning devices are configured to support the two baskets on the frame both at a high height level, both at a low height level, or one at a high height level and one at a low height level.

27. The rack assembly of claim 21, wherein each of the plurality of basket positioning devices comprises at least one of a protrusion or a groove on or in which the basket is positioned.

28. A dishwasher comprising the rack assembly of claim 21.

29. The dishwasher of claim 21, wherein the at least two of the plurality of basket positioning devices formed in each of the plurality of basket receiving spaces comprise an upper supporting portion integrally formed with a lower supporting portion.

30. The dishwasher of claim 21, wherein the at least two of the plurality of basket positioning devices formed in each of the plurality of basket receiving spaces comprise a lower supporting portion that extends from an upper supporting portion.

31. The dishwasher of claim 21, wherein the at least two of the plurality of basket positioning devices formed in each of the plurality of basket receiving spaces comprise an upper supporting portion comprising a first supporting bar and a lower supporting portion comprising a second supporting bar connected to the first supporting bar by a substantially vertically extending connecting member.

* * * * *